US005822898A

United States Patent [19]

Weissleder

[11] Patent Number: 5,822,898

[45] Date of Patent: Oct. 20, 1998

[54] POINT OF SALE DISPLAY UNIT

[76] Inventor: Kenneth L. Weissleder, 4909 Featherbed La., Siesta Key, Fla. 34242

[21] Appl. No.: 317,926

[22] Filed: Oct. 4, 1994

[51] Int. Cl.[6] ..... G09F 13/00

[52] U.S. Cl. ..... 40/442; 40/540; 362/800

[58] Field of Search ..... 40/442, 463, 664, 40/540, 541, 550, 1; 248/346, 346.1, 152; 362/96, 800, 184, 251–252, 276, 802; D20/37

[56] References Cited

U.S. PATENT DOCUMENTS

| | | | |
|---|---|---|---|
| 2,118,326 | 5/1938 | McEwen | 40/443 |
| 2,170,641 | 8/1939 | Lancelot | 40/540 |
| 2,212,642 | 8/1940 | Jackson | 40/442 |
| 2,344,639 | 3/1944 | Ressinger | 40/541 |
| 4,336,574 | 6/1982 | Goodman | 248/346.1 X |
| 4,530,863 | 7/1985 | Seeger | 40/800 X |
| 4,537,806 | 8/1985 | Sherrard | 362/806 X |
| 4,776,549 | 10/1988 | Anastos | 40/600 X |
| 4,924,363 | 5/1990 | Kornelson | 362/184 X |
| 5,255,170 | 10/1993 | Plamp et al. | 362/808 X |
| 5,307,250 | 4/1994 | Pearson | 362/802 X |

OTHER PUBLICATIONS

Foot Illuminated Plastic Santa Figure—No. 33 Noma Lights Catalog, 1952.

*Primary Examiner*—Cassandra Davis
*Attorney, Agent, or Firm*—S. C. Yuter, J.S.D.

[57] ABSTRACT

A point of sale unit is disclosed comprising a platform which supports an actual product on sale. The platform has a horizontal support panel, a front panel and side panels. A pictorial sculpture is on the front panel having a theme related to the product. A plurality of lights mounted in a line along part of the pictorial sculpture are repeatedly flashed in sequence by a light flashing circuit. The pictorial sculpture comprises a photo print of a subject related to the product which is screen printed onto acrylic plastic with its outer edges conforming to the outer edges of the subject of the photo print. A pressure sensitive switch mounted on the platform operates the flashing lights only when the product is supported on the horizontal support panel. A manually-operable switch is in parallel with the pressure sensitive switch so that the repeatedly flashing lights may be operated when the product is not supported by the horizontal support panel.

30 Claims, 3 Drawing Sheets

POINT OF SALE DISPLAY UNIT

BACKGROUND OF THE INVENTION

1. Field of the Invention

This invention relates to an improved point of sale display unit and more particularly to such a unit for displaying actual products.

2. Description of the Related Art

Point of sale units are well known. They advertise products available for sale at the establishment displaying the point of sale unit. However, a need has developed for an improved point of sale unit which displays the actual product.

BRIEF SUMMARY OF THE INVENTION

An object of the invention is to provide an improved point of sale unit.

A more specific object of the invention is to provide a point of sale unit which incorporates the actual product offered for sale.

Briefly, in accordance with the invention, a point of sale unit is provided comprising a platform which supports an actual product on sale. The platform has a horizontal support panel, a front panel and side panels. A pictorial sculpture is on the front panel having a theme related to the product. A plurality of lights mounted in a line along part of the pictorial sculpture are repeatedly flashed in sequence by a light flashing circuit.

A feature of the invention is that the pictorial sculpture comprises a photo print of a subject related to the product which is screen printed onto acrylic plastic with its outer edges conforming to the outer edges of the subject of the photo print.

Another feature of the invention is that the pictorial sculpture has an extended part with the repeatedly flashing lights mounted along it. For example, the pictorial sculpture can be a dragon and the extended part with repeatedly flashing lights simulates fire being blown from the mouth of the dragon.

A further feature of the invention is a pressure sensitive switch mounted on the platform for operating the flashing lights only when the product is supported on the horizontal support panel. The pressure sensitive switch preferably comprises a micro switch with a movable horizontal blade which can be depressed by a post which passes through an opening in the horizontal support panel and is supported on the movable horizontal blade. When the product is placed on the horizontal support panel the post is depressed, depressing the horizontal blade to activate the pressure sensitive switch to operate the repeatedly flashing lights.

Still another feature of the invention is a manually-operable switch in parallel with the pressure sensitive switch so that the repeatedly flashing lights may be operated when the product is not supported by the horizontal support panel.

An advantage of the invention is that the pictorial sculpture can be sculptured in fine detail using a prior art photo sculpturing technique with the advertiser's theme screen printed onto acrylic plastic.

Another advantage of the invention is that light emitting diodes can be used as the flashing lights together with a prior art circuit board for repeatedly flashing the lights.

An further advantage of the invention is that the pictorial sculpture can be three-dimensional.

BRIEF DESCRIPTION OF THE DRAWINGS

Other objects, features and advantages of the invention will be apparent from the following Description of the Preferred Embodiment taken together with the accompanying drawing in which.

In the various figures of the drawings like reference characters designate like parts.

DESCRIPTION OF THE PREFERRED EMBODIMENT

Figure 1:
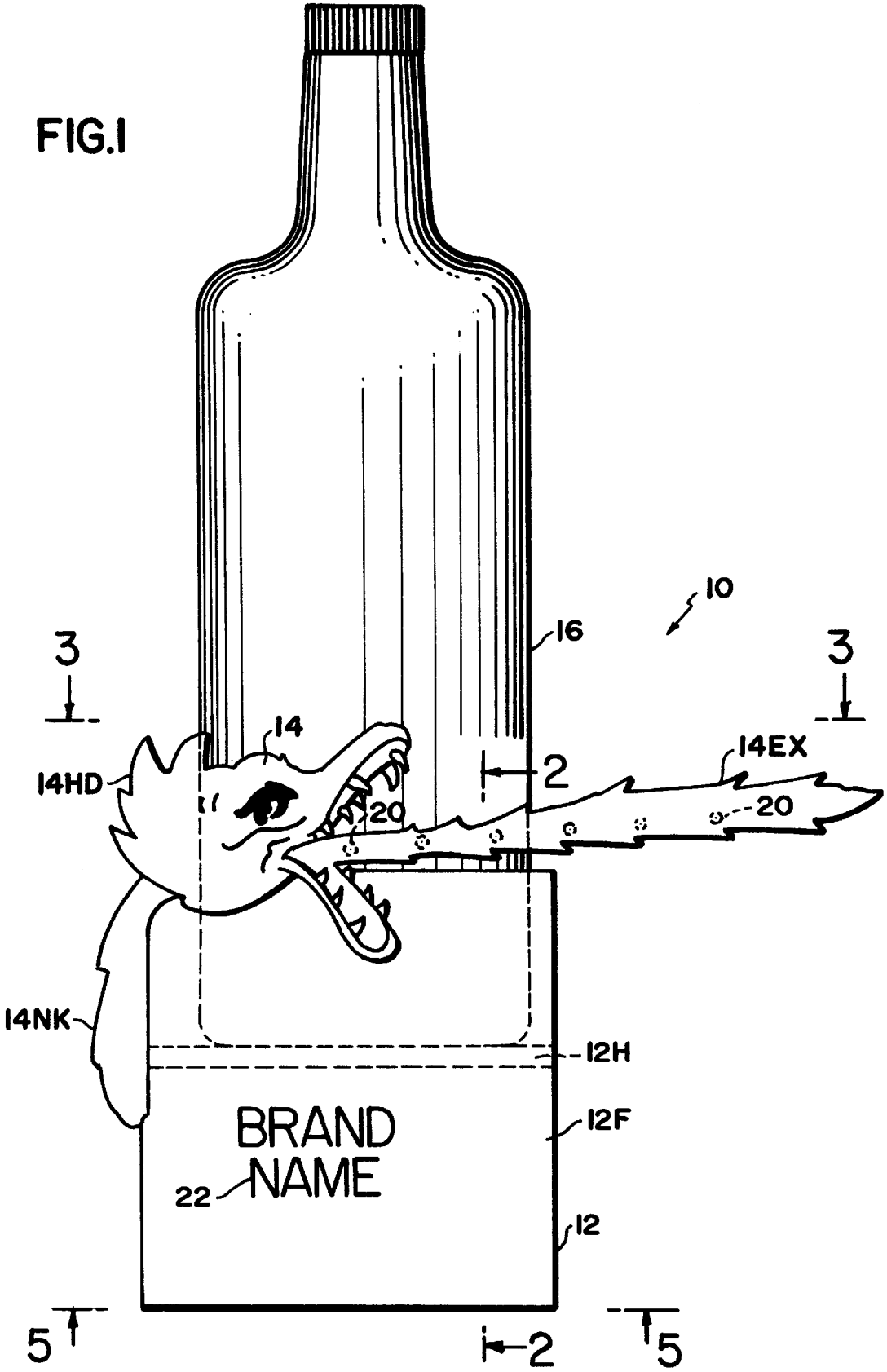
FIG. 1 is a front elevational view of a point of sale unit for supporting an actual beverage bottle in which the pictorial sculpture is made from a photo print of a dragon's head and has an extended part on which are mounted a sequence of light emitting diodes which are repeatedly flashed to simulate the dragon blowing fire from its mouth, and showing the bottom of the bottle and supporting platform in dotted outline.

Referring to FIG. 1 (sheet 1) of the drawing, a point of sale unit 10 is shown having platform 12 with a front panel 12F on which a pictorial sculpture 14 is mounted, and a horizontal support panel 12H which supports a beverage bottle 16 whose bottom end is supported on horizontal support panel 12H as shown in dotted outline.

Figure 2:
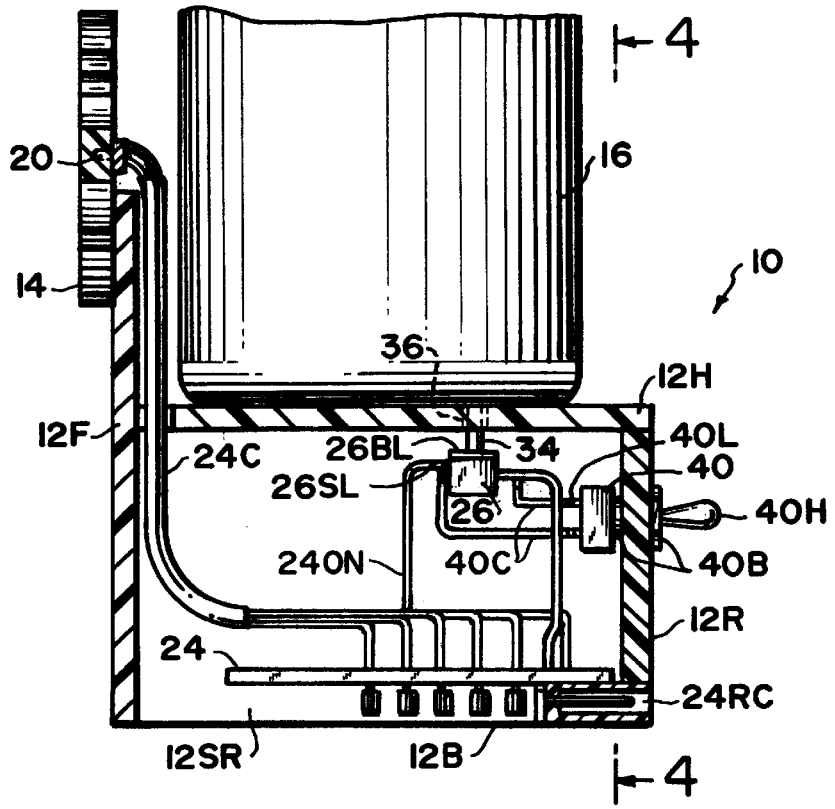
FIG. 2 (drawing sheet 2) is a cross-sectional elevational view of the point of sale unit of FIG. 1, taken along the lines 2—2 of FIG. 1, showing the bottom of the bottle depressing the micro switch blade to operate the repeatedly flashing lights via a circuit board, as well as the toggle switch to operate the lights when the bottle has been removed.
Figure 3:
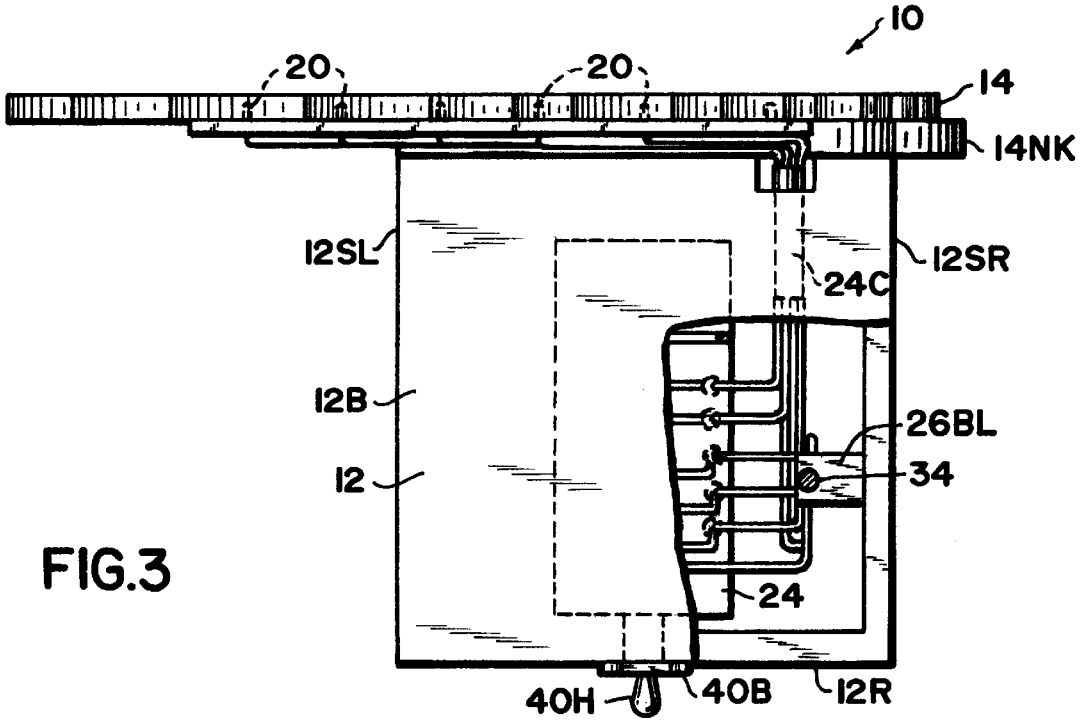
FIG. 3 is a cross-sectional view of the point of sale unit of FIG. 1, taken along the lines 3—3 of FIG. 1, showing the lights in the pictorial sculpture and the top of the horizontal supporting platform, which is partially broken away to show the circuit board and micro switch beneath it.
Figure 4:
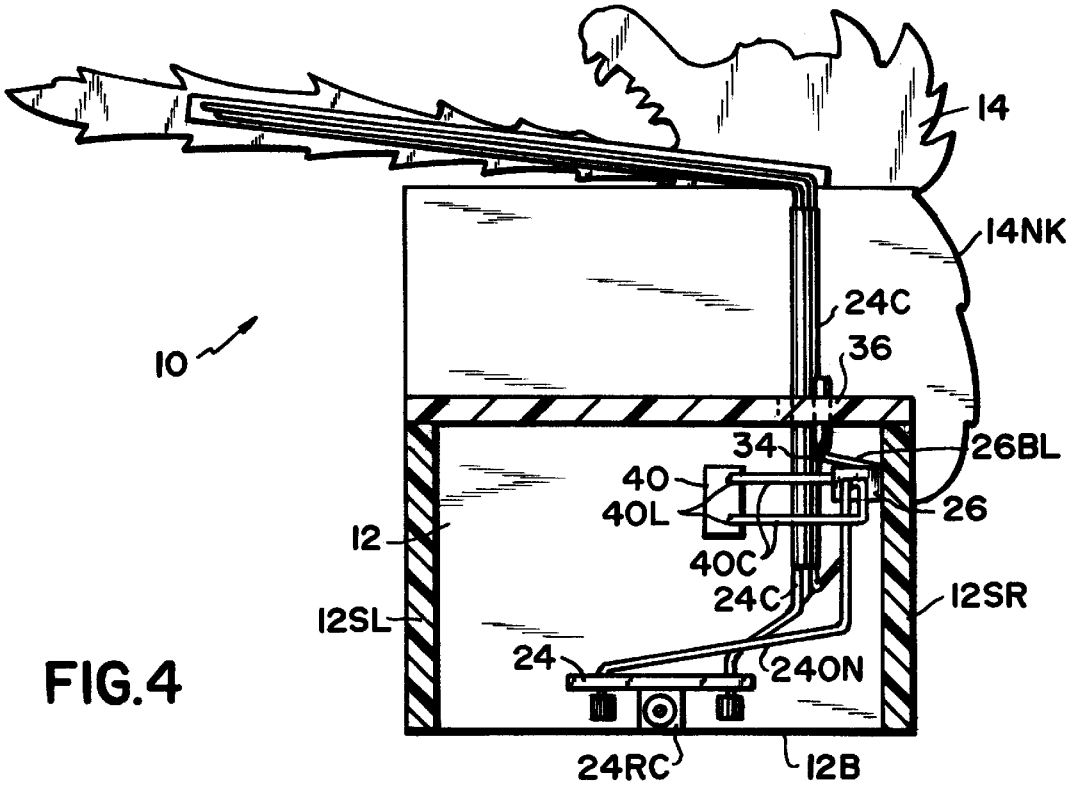
FIG. 4 (sheet 3) is a cross-sectional elevational view of the point of sale unit of FIG. 1, taken along the lines 4—4 of FIG. 2, showing the backside of the front panel of the pictorial sculpture and the micro switch, circuit board and toggle switch, with the micro switch in the open position when the bottle is removed.
Figure 5:
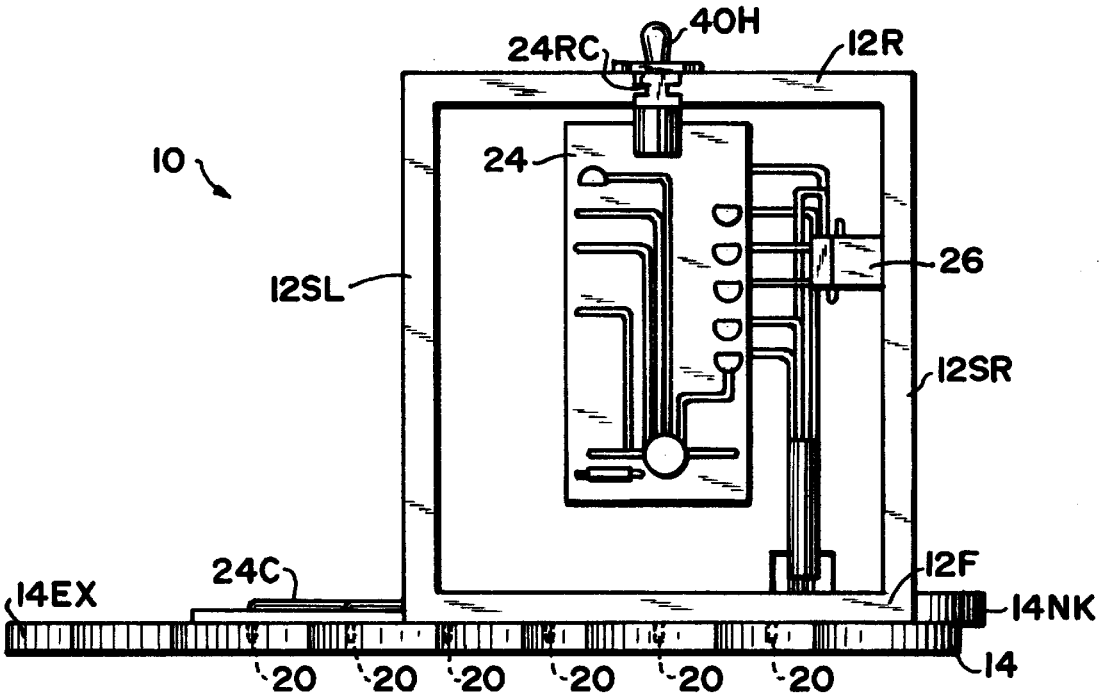
FIG. 5 is a bottom cross-sectional view of the point of sale unit of FIG. 1, taken along the lines 5—5 of FIG. 1, showing the undersides of the pictorial sculpture with the lights in dotted outline, micro switch, circuit board and toggle switch.

Platform 12 (FIGS. 2 and 3) also has a rear panel 12R, a left side panel 12SL, a right side panel 12SR and a bottom panel 12B. It is made from an acrylic plastic such as Lucite or Plexiglass (trademark), and cemented together with a clear solvent acrylic plastic cement such as Weldon No. 3 cement.

The pictorial sculpture 14 (FIG. 1) comprises a dragon head 14HD having an extended part 14EX, which simulates a dragon blowing a stream of fire, and a neck 14NK. The dragon head 14HD and extended part 14EX is mounted on the front surface of front panel 12F by acrylic cement. Neck 14NK is cemented to the side edge of front panel 12F to provide a three-dimensional pictorial sculpture 14.

Six light emitting diodes 20 are linearly mounted in horizontal openings along the extended part 14EX. The six light emitting diodes 20 are repeatedly sequentially flashed to enhance the simulation of the blown stream of fire. A brand name 22 of the beverage bottle 16 is printed on the front panel 12F of the point of sale unit 10.

In the first embodiment of the invention sold the beverage bottle 16 is filled with a cinnamon schnapps liquor and the brand name 22 is "FIRE WATER." The dragon head 14HD and the extended part 14EX simulating a blown stream of fire of the pictorial sculpture 14 are related to the theme of the bottled cinnamon schnapps liquor, which is spicy hot.

In accordance with the invention the light emitting diodes may be in any geometrical shape, such as a wavy line or a circle. And the light emitting diodes may be flashed in any sequence, or in groups, or all at once.

The beverage bottle 16 (FIGS. 2–5, sheets 2 and 3) is supported on the horizontal support panel 12H of the point of sale unit 10, with its bottom portion behind front panel 12F.

A circuit board 24 is designed to repeatedly sequentially activate each of the light emitting diodes 20 when the circuit board 24 is turned on. The circuit board 24 is powered by a three-volt direct current source (not shown) which plugs into a jack 24RC cemented in a slot in rear panel 12R. Six conductors 24C respectively connect the circuit board 24 to each of the six light emitting diodes 20.

A micro switch 26 (FIG. 4) is cemented to the inside surface of side panel 12SR of the point of sale unit 10. The micro switch 26 has a blade 26BL which is spring loaded to angle out from the top of micro switch 26 at an angle of about 30° when the micro switch 26 is in the open position. The micro switch 26 is closed when the blade 26BL is depressed against the body of micro switch 26. When the micro switch 26 is closed it turns on circuit board 24 via connecting conductors 24ON.

A short rod 34 (FIGS. 2 and 4) is loosely mounted in an opening 36 in the horizontal support panel 12H. The bottle 16 (FIG. 2) presses rod 34 downward to press blade 26BL against the body of micro switch 26 to close the switch. When the bottle is removed (FIG. 4), rod 34 extends above the upper surface of horizontal support panel 12H by a distance substantially equal to the distance between the bottom surface of blade 26BL and the top surface of the body of the micro switch 26.

When the micro switch 26 is closed by placing bottle 16 on the horizontal support panel 12H (FIGS. 1 and 2), the circuit board 24 repeatedly and sequentially turns on each of the light emitting diodes 20.

A toggle switch 40 (FIG. 2) is mounted in an opening in rear panel 12R of the point of sale unit 10 via concentric bolts 40B. Toggle switch 40 has a handle 40H which in its up position turns on toggle switch 40 which, via conductors 40C and terminals 40L and 26SL connected across micro switch 26, turns on circuit board 24, whether or not beverage bottle 16 is supported on horizontal support panel 12H. Thus, the light emitting diodes can be activated when the beverage bottle 16 is removed from the point of sale unit 10. Otherwise, the light emitting diodes are automatically activated when the beverage bottle 16 is placed on the horizontal support panel 12H of the point of sale unit 10.

The pictorial sculpture 14 (FIG. 1) is preferably made by first screen printing onto ¼" acrylic plastic a photo of the dragon head 14HD and extended part 14EX simulating blown fire. Then the outline of the subject is cut by a programmable laser cutting machine and cemented to the front surface of front panel 12F. Before then, front panel 12F together with neck 14NK is cut by a programmable laser cutting machine so that the neck 14NK appears behind the dragon head 14HD in a three-dimensional display.

Alternatively, for a small number of units, a print of the dragon head 14HD with extended part 14EX may be adhered to ¼" acrylic plastic, preferably with Super 77 cement, and then cut by a scroll saw, as can the neck 14NK.

The screen printed photo may be prepared using well-known digital computer techniques for manipulation and enhancement.

The light emitting diodes 20, when activated, are lighted or flashed at six flashes per 0.20 to 0.40 seconds, preferably 0.30 seconds. So the flashing rate of each light emitting diode 20 is about 15 to 30 flashes per second, preferably about 20 flashes per second. Each six-diode cycle is repeated every 0.70 to 1.00 seconds, preferably 0.85 seconds.

The circuit board 24 is a CMOS led driver Model No. CL618 supplied by Clegg Industries, Inc. of Torrance, Calif. 90503. It is powered by 3–6 VDC at 20 mA when the light emitting diodes 20 are activated and 200 uA when they are not activated. The light emitting diodes 20 are 1.8 mm GaA1As manufactured by Kingbright, Taiwan. The micro switch 26 can be Radio Shack's Archer Cat. No. 275-016 submini lever switch, single pole double throw, with lug terminals extending from its bottom.

While the point of sale unit 10 is shown with a horizontal support panel 12H for supporting the beverage bottle 16, the support panel can be tilted and the displayed product held from sliding off the support panel by extending the rear panel 12R above the support panel to obtain the equivalent of the horizontal support panel 12H.

Thus, in accordance with the invention, a point of sale unit has been provided accomplishing all of the objects, and having the features and advantages specified at the beginning of this specification.

It is to be understood that the disclosed construction of the invention may be embodied in other forms within the scope of the claims.

What is claimed is:

1. A point of sale unit comprising:

(A) a product;

(B) a platform adapted to support said product, said platform having a horizontal support panel, a front panel having a portion extending vertically a substantial distance above said horizontal support panel, and at least one side panel extending below the horizontal support panel;

(C) a pictorial sculpture mounted on said vertically extending portion of said front panel having a theme related to said product, said pictorial sculpture extending above an upper edge of said vertically extending portion such that said product is visible behind the pictorial sculpture when viewed from the front of the point of sale unit;

(D) a plurality of lights mounted along a front surface of said pictorial sculpture and above said upper edge of said vertically extending portion of said front panel; and (E) light flashing means for repeatedly flashing each of said plurality of lights in a predetermined sequence.

2. The point of sale unit of claim 1 wherein said lights are mounted in a linear sequence and are flashed sequentially.

3. The point of sale unit of claim 1 wherein said pictorial sculpture comprises a photo print related to said product which is bonded onto acrylic plastic.

4. The point of sale unit of claim 1 wherein said pictorial sculpture comprises a photo print having outer edges of a subject related to said product which is bonded onto acrylic plastic having outer edges which conform to said outer edges of said subject of said photo print.

5. The point of sale unit of claim 1 wherein said pictorial sculpture comprises a photo print of a subject related to said product which is screen printed onto acrylic plastic having outer edges conforming to outer edges of said subject of said photo print.

6. The point of sale unit of claim 5 wherein said pictorial sculpture is two-dimensional and said outer edges of said acrylic plastic are cut by a laser cutting tool.

7. The point of sale unit of claim 6 wherein said pictorial sculpture is three-dimensional and said outer edges of said acrylic plastic are cut by a laser cutting tool.

8. The point of sale unit of claim 1 wherein said pictorial sculpture comprises a photo print of a subject related to said product having an extended part which is screen printed onto acrylic plastic having outer edges conforming to outer edges of said subject of said photo print, with said lights mounted along said extended part.

9. The point of sale unit of claim 8 wherein said photo print of said pictorial sculpture depicts a dragon and said extended part simulates fire being blown from the mouth of said dragon.

10. The point of sale unit of claim 9 wherein said lights are mounted in a linear sequence and are adapted to be flashed sequentially by said light flashing means to simulate fire being blown from the mouth of said dragon.

11. The point of sale unit of claim 1 wherein said pictorial sculpture comprises a photo print related to said product and part of said product is supported behind said front panel.

12. The point of sale unit of claim 1 wherein said pictorial sculpture is made by a laser cutting tool.

13. The point of sale unit of claim 1 wherein said pictorial sculpture is made by a scroll saw.

14. A point of sale unit comprising:

(A) a product;

(B) a platform adapted to support said product, said platform having a horizontal support panel, a front panel having a vertically extending portion in front of said product, and at least one side panel extending below the horizontal support panel;

(C) a pictorial sculpture mounted on said front panel, said pictorial sculpture extending above an upper edge of said vertically extending portion such that said product is visible behind the pictorial sculpture when viewed from the front of the point of sale unit;

(D) a plurality of lights mounted along a front surface of said pictorial sculpture and above said upper edge of said vertically extending portion of said front panel; and (E) light flashing means for repeatedly flashing each of said plurality of lights in a predetermined sequence;

(F) said pictorial sculpture comprising a photo print.

15. A point of sale unit for a product on sale comprising:

(A) a platform adapted to support said product on sale, said platform having a horizontal support panel, a front panel having a vertically extending portion and at least one side panel extending below the horizontal support panel;

(B) a pictorial sculpture mounted on said front panel having a theme adapted to relate to said product, said pictorial sculpture extending above an upper edge of said vertically extending portion such that said product is visible behind the pictorial sculpture when viewed from the front of the point of sale unit;

(C) a plurality of lights mounted along a front surface of said pictorial sculpture and above said upper edge of said vertically extending portion of said front panel;

(D) light flashing means for repeatedly flashing each of said plurality of lights in a predetermined sequence; and (E) a pressure sensitive switch mounted on said platform for operating said light flashing means only when said product is supported on said horizontal support panel.

16. The point of sale unit for a product on sale of claim 15 wherein said pictorial sculpture comprises a photo print adapted to relate to said product, and part of said product is adapted to be supported behind said front panel.

17. The point of sale unit for a product on sale of claim 15 wherein said pictorial sculpture comprises a photo print having outer edges of a subject adapted to relate to said product having an extended part which is screen printed onto acrylic plastic and having outer edges which conform to said outer edges of said subject of said photo print, with said lights mounted along said extended part.

18. The point of sale unit for a product on sale of claim 15 wherein said pressure sensitive switch comprises a micro switch mounted beneath said horizontal support panel.

19. The point of sale unit for a product on sale of claim 15 wherein said pressure sensitive switch comprises a micro switch with a movable horizontal blade for activating said micro switch when said blade is depressed and further comprising:

(F) a vertical opening in said horizontal support panel;

(G) a post supported on said movable horizontal blade which passes through said vertical opening and extends above said horizontal support panel;

(H) whereby when said product is placed on said horizontal support panel said post is depressed, depressing said horizontal blade to activate said pressure sensitive switch to operate said light flashing means so that said plurality of lights flash in said predetermined sequence.

20. The point of sale unit for a product on sale of claim 19 wherein said lights are mounted in a linear sequence and are flashed sequentially.

21. The point of sale unit for a product on sale of claim 20 wherein said pictorial sculpture comprises a photo print having outer edges of a subject adapted to relate to said product having an extended part which is screen printed onto acrylic plastic and having outer edges which conform to said outer edges of said subject of said photo print, with said lights mounted along said extended part.

22. The point of sale unit for a product on sale of claim 20 wherein said photo print of said pictorial sculpture depicts a dragon and said extended part simulates fire being blown from the mouth of said dragon.

23. The point of sale unit for a product on sale of claim 15 further comprising a manually-operable switch in parallel with said pressure sensitive switch whereby said light flashing means may be operated when the product is not supported by said horizontal support panel.

24. A point of sale unit for a product on sale comprising:

(A) a platform adapted to support said product on sale, said platform having a horizontal support panel, a front panel having a portion extending vertically in front of said product a substantial distance above said horizontal support panel, and at least one side panel extending below the horizontal support panel;

(B) a pictorial sculpture mounted on said vertically extending portion of said front panel having a theme adapted to relate to said product, said pictorial sculpture extending above an upper edge of said vertically extending portion such that said product is visible behind the pictorial sculpture when viewed from the front of the point of sale unit;

(C) a plurality of lights mounted along a front surface of said pictorial sculpture and above said upper edge of said vertically extending portion of said front panel; and (D) light flashing means for repeatedly flashing each of said plurality of lights in a predetermined sequence;

(E) said lights each being flashed at a rate of 15 to 30 flashes per second.

25. The point of sale unit for a product on sale of claim 24 wherein said lights are each flashed at a rate of 20 flashes per second.

26. The point of sale unit for a product on sale of claim 24 wherein said lights are six light emitting diodes mounted in a linear sequence and all are flashed in 0.20 to 0.40 seconds.

27. The point of sale unit for a product on sale of claim 26 wherein said six light emitting diodes are all flashed every 0.70 to 1.00 seconds.

28. The point of sale unit for a product on sale of claim 26 wherein said six light emitting diodes are all flashed every 0.85 seconds.

29. The point of sale unit for a product on sale of claim 24 wherein said lights are six light emitting diodes mounted in a linear sequence and all are flashed in 0.30 seconds.

30. A point of sale unit comprising:

(A) a product;

(B) a platform adapted to support said product, said platform having a horizontal support panel, a vertical panel having a portion extending vertically a substantial distance above said horizontal support panel, and at least one side panel extending below the horizontal support panel;

(C) a pictorial sculpture Mounted on said vertically extending portion of said vertical panel having a theme related to said product, said pictorial sculpture extending above an upper edge of said vertically extending portion such that said product is visible behind the pictorial sculpture when viewed from the front of the point of sale unit;

(D) a plurality of lights mounted along a front surface of said pictorial sculpture and above said upper edge of said vertically extending portion of said front panel; and (E) light flashing means for repeatedly flashing each of said plurality of lights.

* * * * *